United States Patent [19]

Jacobs

[11] Patent Number: 4,998,987

[45] Date of Patent: Mar. 12, 1991

[54] AUTOMATIC DISC GAUGING AND SORTING APPARATUS

[75] Inventor: William G. Jacobs, San Jose, Calif.

[73] Assignee: Seagate Technology, Inc., Scotts Valley, Calif.

[21] Appl. No.: 561,489

[22] Filed: Aug. 1, 1990

Related U.S. Application Data

[63] Continuation of Ser. No. 276,213, Nov. 23, 1988, abandoned.

[51] Int. Cl.[5] ..... B07C 5/08

[52] U.S. Cl. ..... 209/552; 209/604; 414/404; 414/331; 414/908

[58] Field of Search ..... 209/538, 539, 546, 552, 209/586, 598, 601, 602, 604, 605, 919, 933; 414/404, 416, 908, 331, 787; 33/501.02, 501.03

[56] References Cited

U.S. PATENT DOCUMENTS

| | | | |
|---|---|---|---|
| 3,056,496 | 10/1962 | Rentschler | 209/602 X |
| 3,921,788 | 11/1975 | Roberson, Jr. et al. | 414/404 X |
| 4,759,681 | 7/1988 | Nogami | 414/416 X |
| 4,836,916 | 6/1989 | Kondo et al. | 209/557 X |

FOREIGN PATENT DOCUMENTS

| | | | |
|---|---|---|---|
| 540684 | 12/1976 | U.S.S.R. | 209/933 |
| 573208 | 9/1977 | U.S.S.R. | 209/604 |

*Primary Examiner*—Donald T. Hajec

*Attorney, Agent, or Firm*—Flehr, Hohbach, Test, Albritton & Herbert

[57] ABSTRACT

An automatic disc gauging and sorting apparatus for gauging the thickness of the discs and sorting the discs into a series of predetermined ranges of varying thickness is provided. The apparatus includes a revolving disc sorting unit including a plurality of spaced-apart disc sorting containers arranged concentrically and in one plane. Each of the containers is designated to receive discs of a predetermined thickness range. A cassette transport assembly for transporting cassettes containing discs to be gauged and sorted to a disc pick-up position adjacent the sorting unit and for transporting empty cassettes away from the disc pick-up position is included, as well as a disc gauging unit associated with the sorting unit adjacent the disc pick-up position for gauging the thickness of the discs to be sorted. Finally, a disc shuttle arm unit associated with the sorting unit adjacent the disc pick-up position for removing a disc from a cassette in the disc pick-up position, inserting the disc into the disc gauging unit, removing the disc from the disc gauging unit and placing the disc in the proper container for its designated thickness is provided. A host computer coupled to the disc sorting unit controls the operations of the disc sorting unit, the cassette transport assembly, the disc gauging unit and the shuttle arm unit.

17 Claims, 3 Drawing Sheets

AUTOMATIC DISC GAUGING AND SORTING APPARATUS

BACKGROUND OF THE INVENTION

This invention relates generally to apparatus for handling hard discs. More specifically, this invention relates to an apparatus for automated handling and transfer of hard discs from disc cassette trays to a disc gauging station, where the discs are gauged and their thickness determined, and from there to containers designated to receive discs of a predetermined thickness range.

The thickness of a hard disc must be determined before plating so that the thickness of the plating material to be applied can be determined in order to ensure that all discs are, within certain tolerances, essentially the same thickness. Hence, if prior to plating, one disc is between 48.00–48.19 mils and another is between 48.20–48.39 mils, these discs will be sorted into difference thickness categories before plating. Currently, gauging hard discs during the manufacturing process, and sorting them into ranges of predetermined thickness are carried out by hand. An operator removes a disc from a cassette tray containing discs to be gauged and sorted, and places the disc on a small spindle, which extends through the central aperture in the disc.

While holding the spindle, the operator then moves the disc to a position between a pair of gauging probes in a gauging machine. The probes measure the thickness and the machine gives the operator a digital readout of the thickness. The operator then removes the disc from the gauging machine, takes the disc off the spindle, and carries the disc to the rack designated for its thickness. When a rack is full of discs, the rack is moved to a plating chamber where the discs are plated. An operator working within the foregoing parameters can process, that is, gauge and sort, discs at a maximum rate of approximately 380 per hour. Obviously, many of the foregoing operations could be carried out automatically, by machines, and it would be advantageous to do so to increase speed and accuracy. An apparatus made in accordance with this invention can process at least 1000 discs per hour.

SUMMARY OF THE INVENTION

Briefly, the present invention comprises an automated disc gauging and sorting apparatus for transporting discs to a disc gauging station, gauging the thickness of the discs and sorting the discs into a series of predetermined ranges of varying thickness. It includes a revolving disc sorting unit including a plurality of spaced-apart disc sorting containers arranged concentrically and in one plane. Each of the containers is designated to receive discs of a predetermined thickness range.

It also includes at least one cassette transport means for transporting cassettes containing discs to be gauged and sorted to a disc pick-up position adjacent the sorting unit and for transporting empty cassettes away from the disc pick-up position and at least one disc gauging means associated with the sorting unit adjacent the disc pick-up position for gauging the thickness of the discs to be sorted.

At least one disc shuttle arm unit is associated with the sorting unit adjacent the disc pick-up position for removing a disc from a cassette in the disc pick-up position, inserting that disc into the disc gauging means, removing the disc from the disc gauging means and placing the disc in the proper container for its designated thickness.

Control means coupled to the disc sorting unit controls the operations of the disc sorting unit, the cassette transport means, the disc gauging means and the shuttle arm unit.

The cassette transport means comprises a conveyor having a plurality of cassette ready positions to support a plurality of cassettes, a disc pick-up position and a cassette unloading position. First sensor means, comprising a pair of optical sensors, is mounted on the conveyor at the disc pick-up position for sensing when all of the discs in a cassette in the disc pick-up position have been gauged and sorted. Second sensor means, comprising a plurality of pairs of optical sensors, is associated with the conveyer, one pair at each of the cassette ready positions for sensing the location of each cassette in said conveyor. Cassette retaining means, comprising a cassette retaining lever, is coupled to the conveyor at the disc pick-up position for releasable retaining a cassette at the disc pick-up position during gauging and sorting operations.

The first sensor means is mounted at the disc pick-up position to sense the presence or absence of a disc in a cassette at the disc pick-up position and to signal that presence or absence to the control means.

The second sensor means, comprising a plurality of pairs of optical sensors, each of which is mounted on said conveyor at a cassette ready position to sense the presence or absence or a cassette at that cassette ready position and to signal the presence or absence to the control means.

The conveyor responds to signals from the control means when the first sensor means signals an absence of discs in the cassette in the disc pick-up position to the control means to release that cassette from the disc pick-up position, to transport the empty cassette to the cassette unloading position and to transport the next cassette in line into the disc pick-up position. The conveyor also responds to signals from the control means when the second sensor means signals an absence of a cassette in the ready position adjacent the disc unloading position to the control means to transport the next in line cassette into that ready position so that each of the ready positions contains a cassette.

In a preferred embodiment, the conveyor comprises a plurality of belt pulleys interconnected to revolve simultaneously in response to signals from the control means to transport cassettes from the cassette ready positions to the disc pick-up position and to transport empty cassettes from the disc pick-up position to the cassette unloading position.

The sorting unit comprises a horizontally disposed, circular track mounted on a frame. The disc sorting containers are mounted on the track in spaced-apart relation and at least one disc gauging means and at least one disc shuttle arm unit are disposed within the circumference of the track.

The shuttle arm unit comprises a retractably extendable shuttle arm for extending and retracting between the disc pick-up position and a position adjacent the disc gauging means, a gripping mechanism mounted at one end of said shuttle arm for gripping a disc in the cassette, and a supporting member for supporting the shuttle arm. The supporting member is structure and arranged for moving the shuttle arm from the disc pick-up position to the disc gauging means to insert said disc to be gauged into the gauging means and remove the disc from the disc gauging means. Motor means, connected between the control means and the shuttle arm and its supporting member is further provided to power the operations thereof.

The disc gauging means is aligned with and disposed above the disc pick-up position and the shuttle arm unit is capable of translational motion in planes parallel and perpendicular to the track to lift a disc from the cassette in said the pick-up position, translate to the gauging means, place the disc in the gauging means, release the disc, remove the disc from the gauging means and translate to a disc deposit position to insert and release the disc into a disc sorting container.

In a preferred embodiment, the disc gauging means includes a disc gauge and a gauge sensor connected to the disc gauge. The disc gauge is formed to measure the thickness of a disc inserted therein and the sensor is formed and positioned to signal the thickness measurement to the control means.

Likewise, the control means is formed to receive the signal from the gauge sensor and to direct the sorting unit to rotate until the proper disc sorting container is in the disc deposit position. The control means is also formed to direct the shuttle arm unit to translate to the disc deposit position and to insert and release the disc into the proper container designated for its thickness.

When the disc sorting container is full, the control means automatically rotates to a container unloading position, where an operator of the apparatus can manually remove the sorted and gauged discs from the container by using a mandrell inserted through the central opening in the disc and place them in an appropriate transport or other container for additional processing.

Means for recalibrating the disc gauge is associated with the cassette transport means adjacent the disc pick-up position and connected to the control means for recalibrating the disc gauge periodically after a predetermined number of discs have been gauged and sorted.

If more speed and efficiency are desired, a second cassette transport means, a second disc gauging means, a second disc shuttle arm unit, and a second recalibration means all of which are structured and arranged in the same manner as the first such means and units, can be positioned substantially opposite the first such means and units to operate alternately with such means and units to sort the discs.

The invention also comprises a method of transporting ungauged and unsorted discs from a cassette to a disc gauging station associated with a revolving disc sorting unit and from the disc gauging station to a predetermined container in the disc sorting unit including the steps of transporting a cassette containing ungauged and unsorted discs to a disc gauging station, engaging a disc in said cassette with the shuttle arm, lifting and retracting the disc from the cassette and into the disc gauging station, gauging the thickness of the disc, revolving the predetermined container in the disc sorting unit to a position aligned with and disposed above the disc in the disc gauging station, removing that disc from the disc gauging station and depositing the disc in that container.

The method additionally comprises the steps of sensing when the cassette of ungauged and unsorted discs is empty and simultaneously transporting the empty cassette away from the disc gauging station and a cassette containing ungauged and unsorted discs to the station.

These and other features of the present invention are more easily understood with reference to the following figures.

BRIEF DESCRIPTION OFT HE DRAWINGS

DETAILED DESCRIPTION

Figure 1:
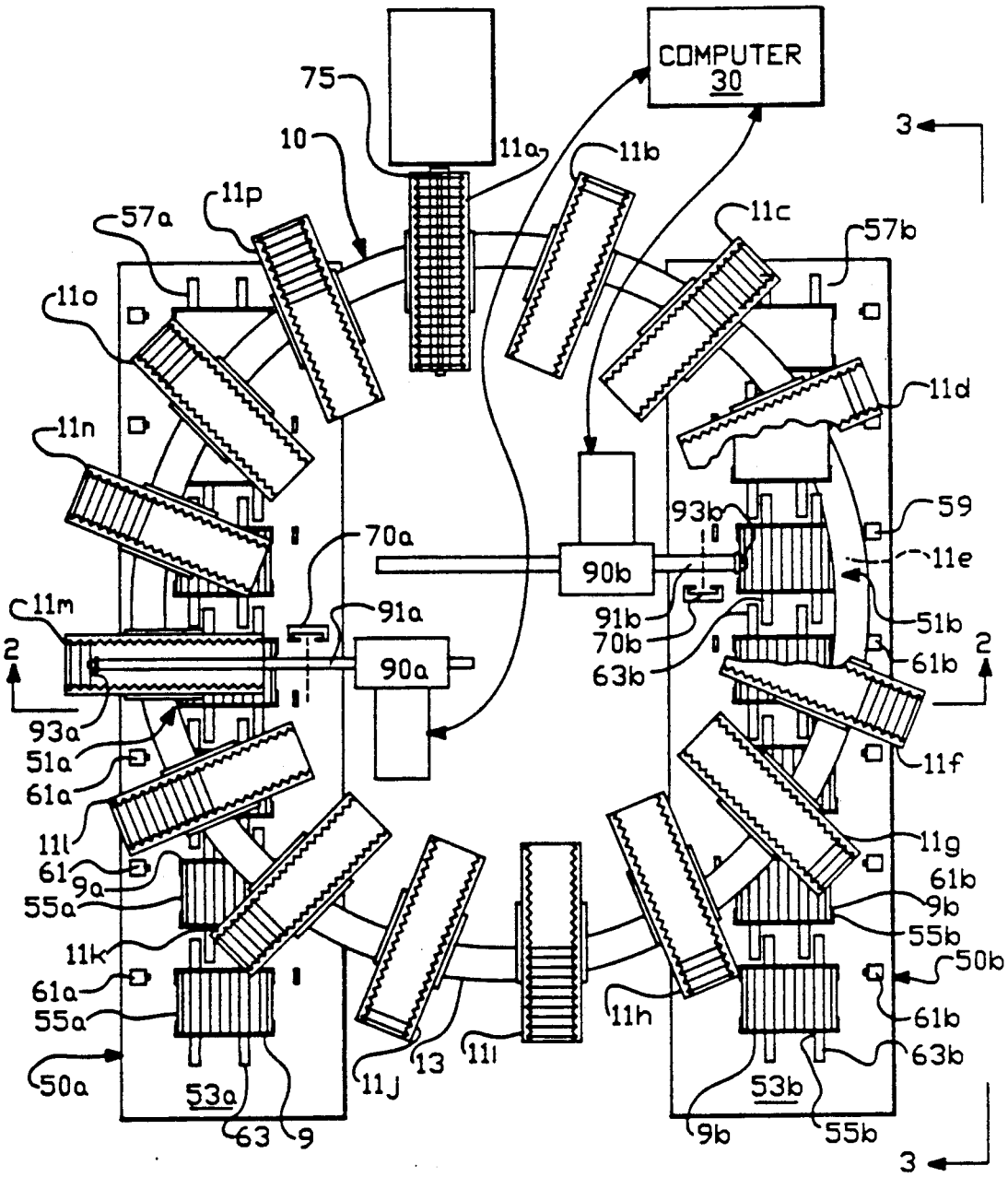
FIG. 1 is a top plan view of the present invention.

One embodiment of the present invention as shown in FIG. 1, includes two sets of cassette transport assemblies which are symmetrical. Each element on the cassette transport assembly on the right side has a corresponding element on the cassette transport assembly on the left side. The elements on the left and right side have the same function. For the purpose of elaboration, a number with index "a" is assigned to an element on the right cassette transport assembly; and the same number with index "b" is assigned to the corresponding element on the left cassette transport assembly. Hereinafter, a non-indexed numeral refers to both the element on the right cassette transport assembly and the corresponding element on the left cassette transport assembly; a numeral indexed "a" or "b" refers either to the element on the right cassette transport assembly or to the corresponding element on the left cassette transport assembly, respectively.

Referring now to FIG. 1, there is shown the automated disc gauging and sorting apparatus of the present invention. In the Figures, the left and right sides of the sorting unit are substantially identical. In the Figures, the same numeral is used for identical parts; the left side part is denoted by letter "A", the right side part by letter "B". With limited exceptions, only numerals will be referred to in the text of the following specification. The apparatus includes a revolving disc sorting unit, generally designated 10. Sorting unit 10 includes a plurality of spaced-apart disc sorting container 11, at positions 11*a* through 11*p*, beginning with the container in the twelve o'clock position and continuing in clockwise direction. Note that the containers at positions 11*d* and 11*f* are shown partially cut away and containers at position 11*e* are not shown so that the operation of the conveyor assembly can be more readily understood.

The containers are arranged concentrically and in one plane, each of containers 11 being designated to receive discs of a predetermined thickness range. For example, container 11 at position 11*p* may be designated to receive discs falling within the thickness range 48.00–48.19 mils and container 11 at position 11*o* may be designated to receive discs falling within the thickness range 48.20–48.39 mils. Container 11 at 11*n* might be designated a "reject" container; that is, a container designated to receive discs falling within none of the designated thickness ranges of the other containers. This designation is made using the control apparatus, generally designated 30, and comprising a host computer, in a manner already known in the art; the general operations of host computer 30 will be set forth in greater detail below.

The present invention also comprises at least one cassette transport assembly, generally designated 50, for transporting cassettes containing discs to be gauged and sorted to a disc pick-up position 51 adjacent sorting unit 10 and for transporting empty cassettes away from disc pick-up position 51, at least one disc gauging assembly generally designated 70, and associated with sorting unit 10 adjacent disc pick-up position 51 for gauging the thickness of the discs to be sorted, and at least one disc shuttle arm unit associated with sorting unit 10 adjacent disc pick-up position 51 for removing a disc from a cassette in the disc pick-up position, inserting that disc into disc gauging assembly 70, removing that disc from disc gauging assembly 70 and placing it in the proper container for its designated thickness.

Control apparatus 30 is coupled to disc sorting unit 10 for controlling its operations and the operations of cassette transport assembly 50, disc gauging assembly 70 and shuttle arm unit 90.

In a preferred embodiment, cassette transport assembly 50 comprises a conveyor 53 having a plurality of cassette ready positions 55A to support a plurality of cassettes, a disc pick-up position 51 and a cassette unloading position 55B. First sensor means are mounted on conveyor 53 at disc pick-up position 51 for sensing when all of the discs in a cassette in disc pick-up position have been gauged and sorted. Second sensor means are associated with conveyer 53 at each of the cassette ready positions, 55, for sensing the location of each cassette in conveyor 51. A cassette retaining arrangement is coupled to conveyor 53 at disc pick-up position 51 for releasably retaining a cassette at disc pick-up position 51 during gauging and sorting operations.

The first sensor means comprises an optical sensor, 59, mounted at disc pick-up position 51 to sense the presence or absence of a disc in a cassette at disc pick-up position 51 and to signal that presence or absence to host computer 30.

The second sensor means comprise a plurality of optical sensors, 61. Each of these optical sensors is mounted on conveyor 53 at cassette ready positions 55 to sense the presence or absence or a cassette at the cassette ready positions and to signal that presence or absence to host computer 30.

Accordingly, conveyor 53 responds to signals from host computer 30 when first optical sensor 59 signals an absence of discs in the cassette in disc pick-up position 51. Host computer 30 signals to cassette transport means 50 to release the empty cassette from disc pick-up position 51, to transport the empty cassette to cassette unloading position 57, and to transport the next cassette in line from a cassette ready position 55 into disc pick-up position 51.

Additionally conveyor 53 responds to signals from host computer 30 when second optical sensor 61 signals an absence of cassette in the ready position 55 adjacent disc unloading position 57. Host computer 30 then directs the movement of conveyor 53 to transport the next in line cassette into that ready position so that each of the ready positions 55 supports a cassette containing discs to be gauged and sorted.

Figure 3:
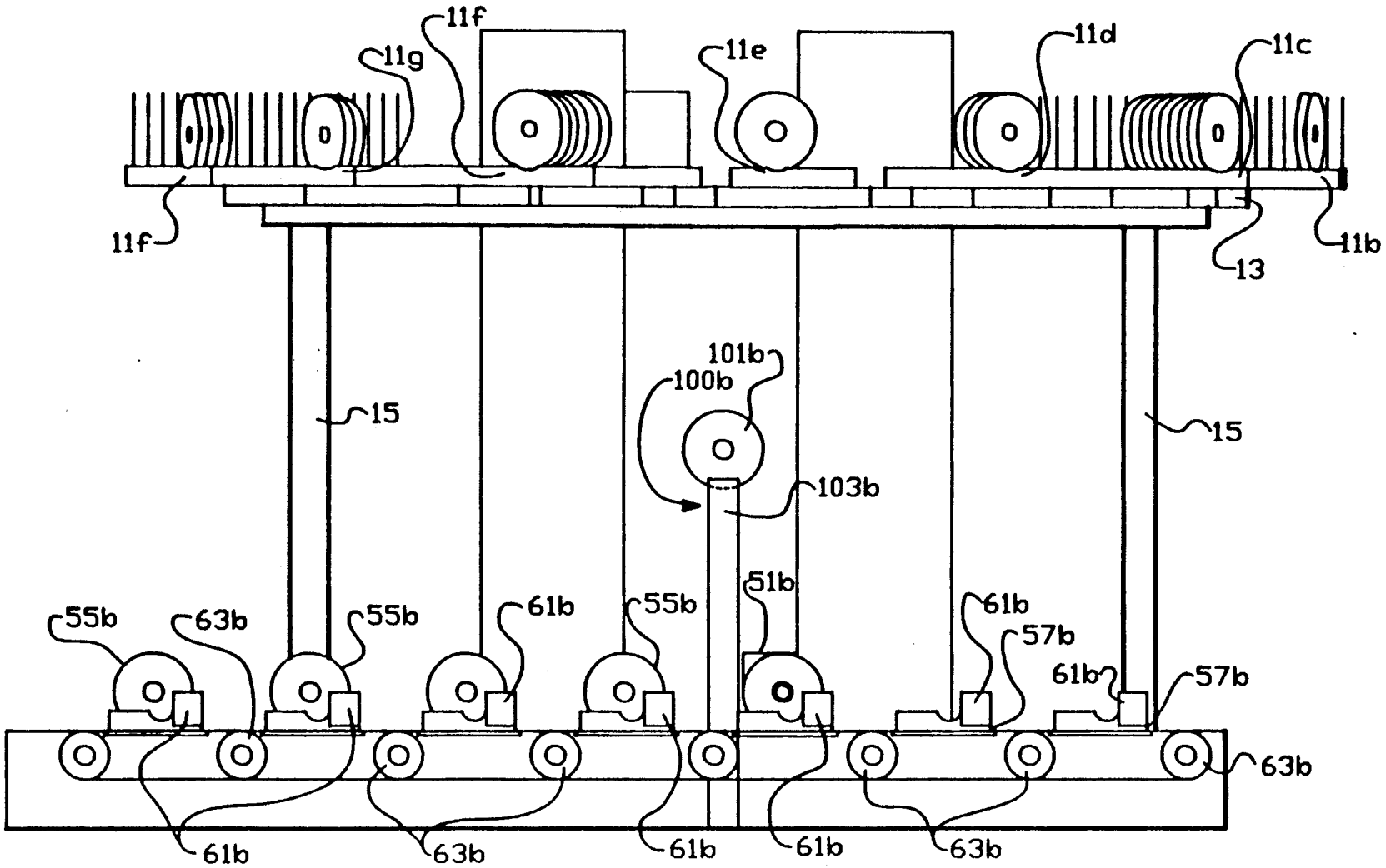
FIG. 3 is a section view of FIG. 1, taken along the line 3—3 of FIG. 1.

As best seen in FIG. 3, in a preferred embodiment, conveyor 53 comprises a plurality of belt pulleys, 63, interconnected to revolve simultaneously in response to signals from host computer 30 to transport cassettes from the cassette ready positions 55 to disc pick-up position 51 and to transport empty cassettes from disc pick-up position 51 to cassette unloading position 57.

Sorting unit 10 of the present invention comprises a horizontally disposed circular track 13 mounted on a frame, 15, with disc sorting containers 11 being mounted in spaced-apart relation on track 13. Disposed within the circumference of track 13 are at least one disc gauging assembly 70 and at least one disc shuttle arm unit 90 as best seen in FIG. 1.

Shuttle arm unit 90, in a preferred form, comprises a retractably extendable shuttle arm 91 for extending and retracting between disc pick-up position 51 and a position adjacent disc gauging assembly 70, a gripping mechanism 93 mounted at one end of shuttle arm 91 for gripping a disc in the cassette and a supporting member, 95, for supporting shuttle arm 91. Supporting member 95 is structured and arranged for moving shuttle arm 91 from disc pick-up position 51 to disc gauging assembly 70, to insert the disc to be gauged into gauging assembly 70 and remove the disc therefrom in a manner already known in the art. Motor means, 97 is connected between host computer 30 and shuttle arm 71 of shuttle arm unit 90 and its supporting member 95 to power the operations of the shuttle arm unit in response to signals from the host computer.

Disc gauging means 70 is aligned with and disposed above disc pick-up position 51, and shuttle arm unit 90 is capable of translational motion in planes parallel and perpendicular to track 13 to lift a disc from a cassette in pick-up position 51, translate to gauging assembly 70, place the disc in gauging assembly 70, release the disc, remove the disc from gauging assembly 70 and translate to a disc deposit position **11*e* or 11*m* to insert and release the disc into the appropriate disc sorting container 11**.

Disc gauging means 70 includes a disc gauge, 71, and a gauge sensor (not shown), connected to the disc gauge and formed and positioned to signal host computer 30. Disc gauge 71 is formed to measure the thickness of a disc inserted therein in a manner already known in the art. Consequently, the details of its operation need not be set forth here. After gauge 71 measures the thickness of the disc, the gauge sensor signals the thickness measurement to host computer 30 which then directs sorting unit 10 to rotate until the proper disc sorting container is in disc deposit position **11*e*. Host computer 30 then directs shuttle arm unit 90 to translate to disc gauge 71 and remove the disc from gauge 71 and insert and release the disc into the proper container designated for its thickness which has already been rotated to disc deposit position 11*m*. When a container becomes full, host computer 30 directs sorting unit 10 to rotate until the full container is at container unloading position 11*a*, whereupon an operator can manually remove the gauged and sorted discs using a mandrell, 75, as shown in FIG. 1**.

The apparatus of the present invention further comprises an assembly, 100, associated with cassette transport 50 mounted adjacent disc pick-up position 51 and connected to host computer 30 for recalibrating disc gauge 71 periodically after a predetermined number of discs have been gauged and sorted. Specifically, a gold standard disc 101 is conveniently mounted on a support 103. After, for example, 50 discs have been gauged and sorted, host computer 30 directs shuttle arm 91 to grasp gold Recalibration is then carried out in a manner known in the art and gold standard disc 101 is returned to its support, 103, by shuttle arm 91.

Figure 2:
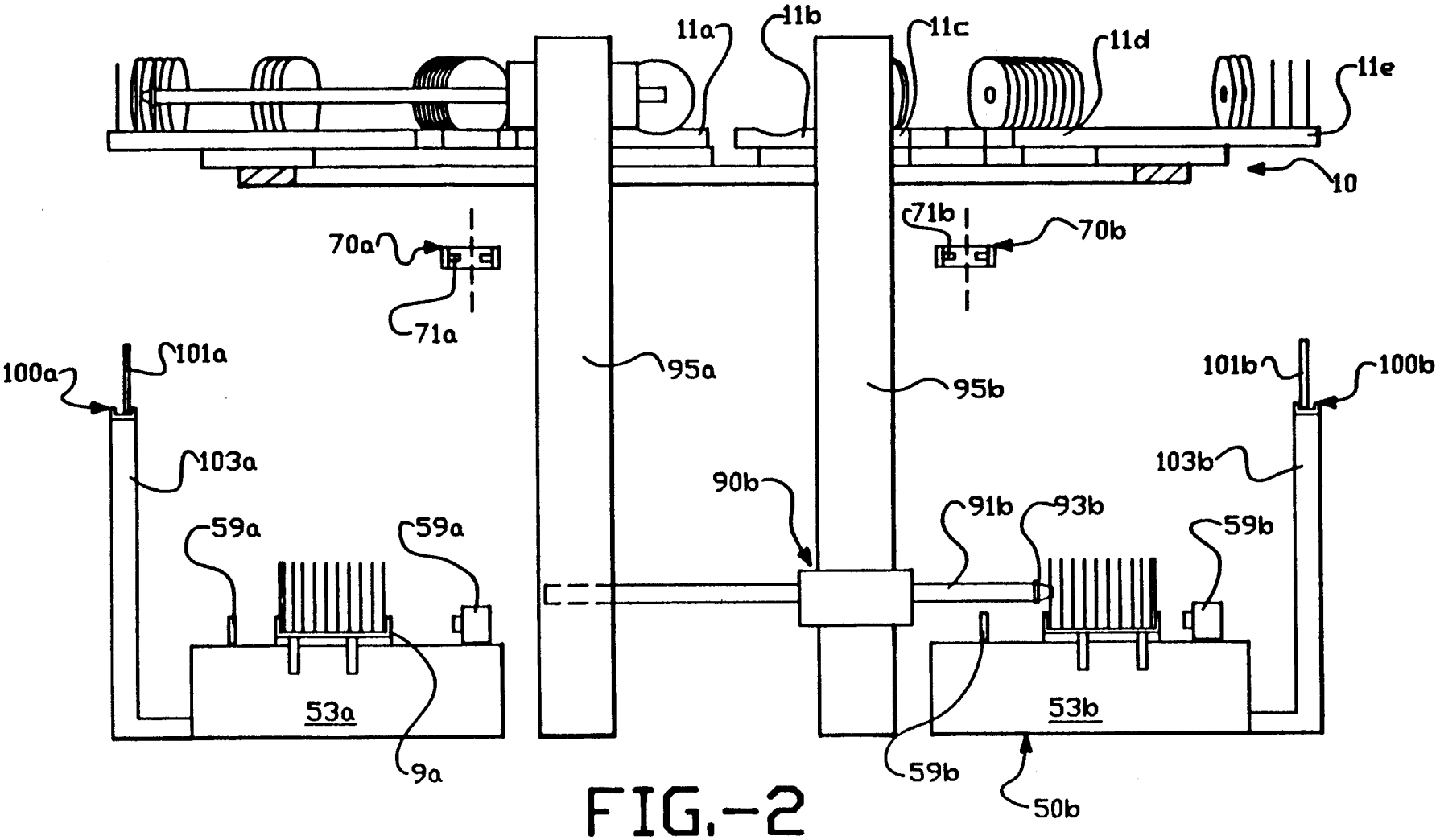
FIG. 2 is section view of FIG. 1, taken along the line 2—2 of that figure.

In order to increase efficiency ever more, the apparatus of the present invention is designed to accommodate a second cassette transport assembly, a second disc gauging assembly, a second disc shuttle, an assembly, and a second recalibration assembly. These assemblies and units and their constituent parts are shown in FIGS. 1 and 2 and designated with the same numerals as the assemblies and units, and their constituent parts, already discussed, except that a letter "a" designation follows the numerals for the assemblies, units and parts already discussed and a letter "b" designation follows the numerals for the second assemblies, units and parts. For the disc sorting unit 10, as best seen in FIG. 1, disc deposit position 11*m* is involved in the already discussed operations with shuttle arm unit 90*a* and cassette transport assembly 50*a*, and disc deposit position 11*e* is involved in the operation of the second, mirror image assembly with shuttle arm unit 90*b* and cassette transport assembly 50*b*. Container unloading position 11*a* operates for both "a" and "b" units. All of the second "b" units, assemblies and parts are structured and arranged in the same manner as the assemblies, units and parts already discussed so details thereof need not be set forth again. However, the second assemblies and units should be positioned substantially opposite their counterpart assemblies and units as if, as best seen in FIG. 1, they were mirror images of the counterpart assemblies and units. The second assemblies and units operate alternately with the already described assemblies and units, as directed by host computer 30.

The present invention also comprises a method of transporting ungauged and unsorted discs from a cassette to a disc gauging station associated with a revolving disc sorting unit and from the disc gauging station to a predetermined container in the disc sorting unit. The method comprises the steps of transporting the cassette containing ungauged and unsorted discs to the disc gauging station, engaging a disc in the cassette with a movable shuttle arm, lifting and retracting the disc from the cassette with the shuttle arm and transporting it to the disc gauging station and inserting it therein; gauging the thickness of the disc; revolving the container in the disc sorting unit predetermined for the disc's thickness to a positioned aligned with and disposed above the disc in the disc gauging station; removing the disc from the disc gauging station and depositing the disc in the proper container.

The method comprises the additional steps of sensing when the cassette of ungauged and unsorted discs is empty and simultaneously transporting the empty cassette from the disc gauging station and a cassette containing ungauged and unsorted discs to the station.

While the foregoing detailed description provides a full and complete description of the preferred embodiments of the invention, various modifications, alternate constructions, and equivalents may be employed without departing from the scope of the invention. Accordingly, the foregoing description and illustrations should not be construed as limiting the scope of the invention, defined by the following claims.

I claim:

1. An automatic disc gauging and sorting apparatus for transporting discs to a disc gauging station, gauging the thickness of the discs and sorting the discs into a series of predetermined ranges of varying thickness comprising:

at least one cassette transport means, each of said transport means having a disc pick-up position and said transport means also having plurality of disc transport containers mounted on said cassette transport means, said plurality of transport containers are able to move towards and away from said disc pick-up position;

at least one disc gauging means adjacent said disc pick-up position for gauging the thickness of the discs to be sorted;

disc sorting unit including a plurality of spaced apart disc sorting containers which are mounted on said disc sorting unit, said disc sorting containers are movable to a location adjacent said disc gauging means, said location being where discs to be gauged and sorted are transferred from said plurality of cassette transport containers to said disc sorting containers, each of said containers being designated to receive discs of a single predetermined thickness range selected from a plurality of thickness ranges:

at least one disc shuttle arm unit associated with said disc sorting unit adjacent said disc pick-up position for removing a disc from a cassette in said disc pick-up position, inserting said disc into said disc gauging means, removing said disc from said disc gauging means and placing said disc in the proper designated container for its determined thickness; and control means coupled to said disc sorting unit for controlling the operations of said disc sorting unit, said cassette transport means, said disc gauging means and said shuttle arm unit.

2. The apparatus of claim 1 wherein said cassette transport means comprises a conveyor having a plurality of cassette ready positions to support a plurality of cassettes, first sensor means mounted on said conveyor at said disc pick-up position for sensing when all of the discs in a cassette in said disc pick-up position have been gauged and sorted, second sensor means associated with said conveyor at each of said cassette ready positions for sensing the location of each cassette in said conveyor, and cassette retaining means coupled to said conveyor at said disc pick-up position for releasably retaining a cassette at said disc pick-up position during gauging and sorting operations.

3. The apparatus of claim 2 wherein said first sensor means comprises an optical sensor mounted at said disc pick-up position to sense the presence or absence of a disc in a cassette at said disc pick-up position and to signal said presence or absence to said control means.

4. The apparatus of claim 3 wherein said second sensor means comprise a plurality of optical sensor, said optical sensors being mounted on said conveyor in such a way that a cassette ready position corresponds at least one of said optical sensors to sense the presence or absence of a cassette at said cassette ready position and to signal said presence or absence to said control means.

5. The apparatus of claim 3 wherein said conveyor responds to signals from said control means when said first sensor means signals an absence of discs in said cassette in said disc pick-up position to said control means to release said cassette from said disc pick-up position, to transport the empty cassette to said cassette unloading position and to transport the next cassette in line into said disc pick-up position.

6. The apparatus of claim 4 wherein said conveyor responds to signals from said control means when said second sensor means signals an absence of a cassette in the ready position adjacent said disc unloading position to said control means to transport the next in line cassette into that ready position so that each of said ready positions contains a cassette.

7. The apparatus of claim 6 wherein said conveyor comprises a plurality of belt pulleys interconnected to revolve simultaneously in response to signals from said control means to transport cassettes from said cassette ready positions to said disc pick-up position and to transport empty cassettes from said disc pick-up position to said cassette unloading position.

8. The apparatus of claim wherein said sorting unit comprises a horizontally disposed circular track mounted on a frame, said disc sorting containers being mounted in spaced-apart relation on said track, said at least one disc gauging means and at least one disc shuttle arm unit being disposed within the circumference of said track.

9. The apparatus of claim 1 wherein said shuttle arm unit comprises a retractably extendable shuttle arm for extending and retracting between said disc pick-up position and a position adjacent said disc gauging means, a gripping mechanism mounted at one end of said shuttle arm for gripping a disc in said cassette, a supporting member for supporting said shuttle arm, said supporting member being structured and arranged for moving said shuttle arm from said disc pick-up position to said disc gauging means to insert said disc to be gauged into said gauging means and remove said disc therefrom, and motor means connected between said control means and said shuttle arm and said supporting member to power the operations thereof.

10. The apparatus of claim 8 wherein said disc gauging means is aligned with and disposed above said disc pick-up position and said shuttle arm unit is capable of translational motion in planes parallel and perpendicular to said track to lift a disc from said cassette in said pick-up position, translate to said gauging means, place said disc in said gauging means, release said disc, remove said disc from said gauging means and translate to a disc deposit position to insert and release said disc into one or said disc sorting containers.

11. The apparatus of claim 10 wherein said disc gauging means includes a disc gauge and a gauge sensor connected to said disc gauge, said disc gauge being formed to measure the thickness of a disc inserted therein and said sensor being formed and positioned to signal the thickness measurement to said control means.

12. The apparatus of claim 11 wherein said control means is formed to receive said signal from said gauge sensor and to direct said sorting unit to rotate until the proper disc sorting container is in said disc deposit position and to direct said shuttle arm unit to translate to said disc deposit position and to insert and release said disc into the proper container designated for its thickness.

13. The apparatus of claim 12 further comprising means associated with said sorting unit adjacent said cassette unloading position and connected to said control means for recalibrating said disc gauging means periodically after a predetermined number of discs have been gauged and sorted.

14. The apparatus of claim 1 further comprising a second cassette transport means for transporting cassettes containing discs to be gauged and sorted to a second disc pick-up position and for transporting empty cassettes away from said disc pick-up position;

a second disc gauging means associated with said sorting unit for gauging the thickness of said discs;

a second disc shuttle arm unit associated with said sorting unit for removing a disc from a cassette in said disc pick-up position, inserting said disc into said second disc gauging means, removing said disc from said second disc gauging means and placing said disc in the proper container designated for its thickness;

a recalibration means associated with said sorting unit adjacent said cassette unloading position and connected to said control means for recalibrating said disc gauging means periodically after a predetermined number of discs have been gauged and sorted;

said second cassette transport means, second disc gauging means, second shuttle arm unit and second recalibration means being structured and arranged in the same manner as said first such means and units, and being positioned substantially opposite said first such means and units and operative alternately with such means and units to sort said discs.

15. A method of transporting ungauged and unsorted discs from a plurality of cassette transport containers, which are mounted on a cassette transport assembly, which are used to hold the ungauged and unsorted discs, and which can move towards and away from disc pick-up position on the cassette transport assembly, to a plurality of disc sorting containers, which are mounted on a disc sorting unit and each of said disc sorting containers is designated to receive discs of a single predetermined thickness range through a disc gauging station which is at a location adjacent to the disc pick-up position, comprising:

transporting one of said disc transport containers containing ungauged and unsorted discs to said disc pick-up position;

engaging a disc in aid disc cassette transport container;

lifting and retracting said disc from said disc transport container, transporting said disc to said disc gauging station and inserting said disc therein, into said disc gauging station;

gauging the thickness of said disc;

moving the disc sorting unit so that a designated disc sorting container is moved to a position adjacent said location whereby the designated sorting container is aligned with and disposed above said disc in said disc gauging station;

removing said disc from said disc gauging station; and depositing said disc in said designated disc sorting container.

16. The method of claim 15 comprising the further steps of:

sensing when said disc transport container is empty; and moving said empty disc transport container away from said disc pick-up position and simultaneously moving another disc transport container which contains ungauged and unsorted discs to said disc pick-up position.

17. The method of claim 16 comprising the further steps of:

moving said disc sorting container to a position where all discs in said disc sorting container are deposited in a proper container when said disc sorting container is full.

* * * * *